US011629608B2

(12) United States Patent
Senoo et al.

(10) Patent No.: US 11,629,608 B2
(45) Date of Patent: Apr. 18, 2023

(54) AXIAL FLOW TURBINE

(71) Applicant: Mitsubishi Heavy Industries, Ltd., Tokyo (JP)

(72) Inventors: Shigeki Senoo, Tokyo (JP); Kazuhiro Momma, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 228 days.

(21) Appl. No.: 16/708,753

(22) Filed: Dec. 10, 2019

(65) Prior Publication Data

US 2020/0277869 A1 Sep. 3, 2020

(30) Foreign Application Priority Data

Feb. 28, 2019 (JP) ..... JP2019-035923

(51) Int. Cl.

*F01D 9/04* (2006.01)
*F01D 5/30* (2006.01)
*F01D 5/14* (2006.01)

(52) U.S. Cl.

CPC ..... *F01D 9/041* (2013.01); *F01D 5/143* (2013.01); *F01D 5/303* (2013.01); *F05D 2220/30* (2013.01)

(58) Field of Classification Search

None

See application file for complete search history.

(56) References Cited

U.S. PATENT DOCUMENTS 6,669,445 B2 * 12/2003 Staubach ..... F01D 5/143 416/193 A
8,177,499 B2 * 5/2012 Iida ..... F01D 9/041 415/208.1

(Continued)

FOREIGN PATENT DOCUMENTS

JP 2014-234714 A 12/2014
JP 2017-8756 A 1/2017

OTHER PUBLICATIONS

Hindi-language Office Action issued in Indian Application No. 201914052098 dated Jan. 18, 2021 with English translation (7 pages).

(Continued)

*Primary Examiner* — Kayla McCaffrey
(74) *Attorney, Agent, or Firm* — Crowell & Moring LLP

(57) ABSTRACT

To provide an axial flow turbine that can reduce circumferential pressure differences to reduce loss. The axial flow turbine includes: stator blades arrayed in the circumferential direction; and a diaphragm inner ring having an outer circumferential surface that interconnects the stator blades on their inner-circumference side and constitutes a wall surface of a main flow path. The outer circumferential surface of the diaphragm inner ring has depressed portions. Each depressed portion is formed in an area that is on the downstream side of a throat where the distance between a suction surface of one stator blade of a pair of adjacent blades and a pressure surface of other stator blade of the pair of adjacent blades becomes the shortest, and that lies in the circumferential direction within a range of a throat position on the suction surface of the one stator blade to a downstream edge position of the one stator blade. The area includes a downstream edge position of the outer circumferential surface in the axial direction.

5 Claims, 4 Drawing Sheets

(56) References Cited

U.S. PATENT DOCUMENTS

| | | | | |
|---|---|---|---|---|
| 9,745,850 | B2 * | 8/2017 | Guendogdu | F01D 5/143 |
| 10,041,353 | B2 * | 8/2018 | Gier | F01D 5/142 |
| 2003/0165382 | A1 | 9/2003 | Suzuki et al. | |
| 2012/0201663 | A1 | 8/2012 | Praisner et al. | |
| 2014/0044551 | A1 * | 2/2014 | Mahle | F01D 5/143 416/223 R |
| 2016/0369654 | A1 | 12/2016 | Fukushima et al. | |
| 2017/0218769 | A1 | 8/2017 | Venugopal et al. | |
| 2017/0350264 | A1 | 12/2017 | Terada | |
| 2018/0328185 | A1 * | 11/2018 | Maatouk | F01D 9/041 |
| 2019/0003323 | A1 | 1/2019 | Shirley et al. | |

OTHER PUBLICATIONS

Korean-language Office Action issued in Korean Application No. 10-2019-0160346 dated Dec. 13, 2020 (4 pages).
German-language Office Action issued in German Application No. 10 2019 220 025.7 dated Apr. 8, 2022 (11 pages).

* cited by examiner

AXIAL FLOW TURBINE

BACKGROUND OF THE INVENTION

1. Field of the Invention

The present invention relates to an axial flow turbine used for a steam turbine, gas turbine or the like at power plants.

2. Description of the Related Art

For example, an axial flow turbine includes: an annular diaphragm outer ring provided on an inner-circumference side of a casing; a plurality of stator blades that are provided on an inner-circumference side of the diaphragm outer ring and arrayed in a circumferential direction; a diaphragm inner ring provided on an inner-circumference side of the plurality of stator blades; a rotor; a plurality of moving blades that are provided on an outer-circumference side of the rotor, positioned on a downstream side of the plurality of stator blades, and arrayed in the circumferential direction; and a shroud provided on an outer-circumference side of the plurality of moving blades, see JP-2017-008756-A, for example.

A main flow path of the axial flow turbine is constituted by a flow path formed between an inner circumferential surface of the diaphragm outer ring and an outer circumferential surface of the diaphragm inner ring, and a flow path formed between an inner circumferential surface of the shroud and an outer circumferential surface of the rotor. It is configured such that working fluid flowing through the main flow path is accelerated and caused to turn by the stator blades, and thereafter applies rotational force to the moving blades.

A first cavity is formed between the diaphragm inner ring and the rotor. Part of the working fluid flows into the first cavity from an upstream side of the stator blades in the main flow path, and flows out of the first cavity to the downstream side of the stator blades in the main flow path. Since the part of the working fluid is neither accelerated nor caused to turn by the stator blades, loss occurs. In order to reduce the loss, the first cavity is provided with a labyrinth seal.

A second cavity is formed between the shroud and the diaphragm outer ring, or the casing. Part of the working fluid flows into the second cavity from an upstream side of the moving blades in the main flow path, and flows out of the second cavity to a downstream side of the moving blades in the main flow path. Since the part of the working fluid does not apply rotational force to the moving blades, loss occurs. In order to reduce the loss, the second cavity is provided with a labyrinth seal.

SUMMARY OF THE INVENTION

Meanwhile, there is typically a circumferential pressure distribution produced on an outlet side of the stator blades or moving blades in the main flow path. Explaining specifically, a static pressure becomes relatively lower in an area that is on a downstream side of a throat where a distance between a suction surface, or a rear surface, of one blade of a pair of adjacent blades and a pressure surface, or a front surface, of the other blade of the pair of adjacent blades becomes the shortest, and that lies in the circumferential direction within a range of a throat position on the suction surface of the one blade to a downstream edge position of the one blade. Accordingly, a flow to spout out of a cavity toward the main flow path is generated in the area. On the other hand, the static pressure becomes relatively higher in an area that is on the downstream side of the throat, and that lies in the circumferential direction within a range of the throat position on the suction surface of the one blade to a downstream edge position of the other blade. Accordingly, a flow to leak out of the main flow path toward the cavity is generated in the area. Then, due to a difference between the flows in the circumferential direction, interference loss, specifically, merging loss on the outlet side of the cavity and branching loss on the inlet side of the cavity, increases. In addition, due to the influence of the difference between the flows mentioned before, secondary flow loss at blades on the downstream side increases.

The present invention is to provide an axial flow turbine that can reduce circumferential pressure differences to reduce loss.

In order to achieve an object explained above, the present invention provides an axial flow turbine including: a plurality of blades arrayed in a circumferential direction; and a member having a circumferential surface that interconnects the plurality of blades on their inner-circumference side or outer-circumference side and constitutes a wall surface of a main flow path. The circumferential surface of the member has a plurality of depressed portions, and each of the depressed portions is formed in an area that is on a downstream side of a throat where a distance between a suction surface of one blade of a pair of adjacent blades and a pressure surface of other blade of the pair of adjacent blades becomes a shortest, and that lies in the circumferential direction within a range of a throat position on the suction surface of the one blade to a downstream edge position of the one blade. Further, the area includes a downstream edge position of the circumferential surface in an axial direction.

According to the present invention, it is possible to reduce circumferential pressure differences to reduce loss.

DESCRIPTION OF THE PREFERRED EMBODIMENTS

Hereinafter, embodiments of the present invention in cases when the present invention is applied to a steam turbine are explained with reference to the drawings.

Figure 1:
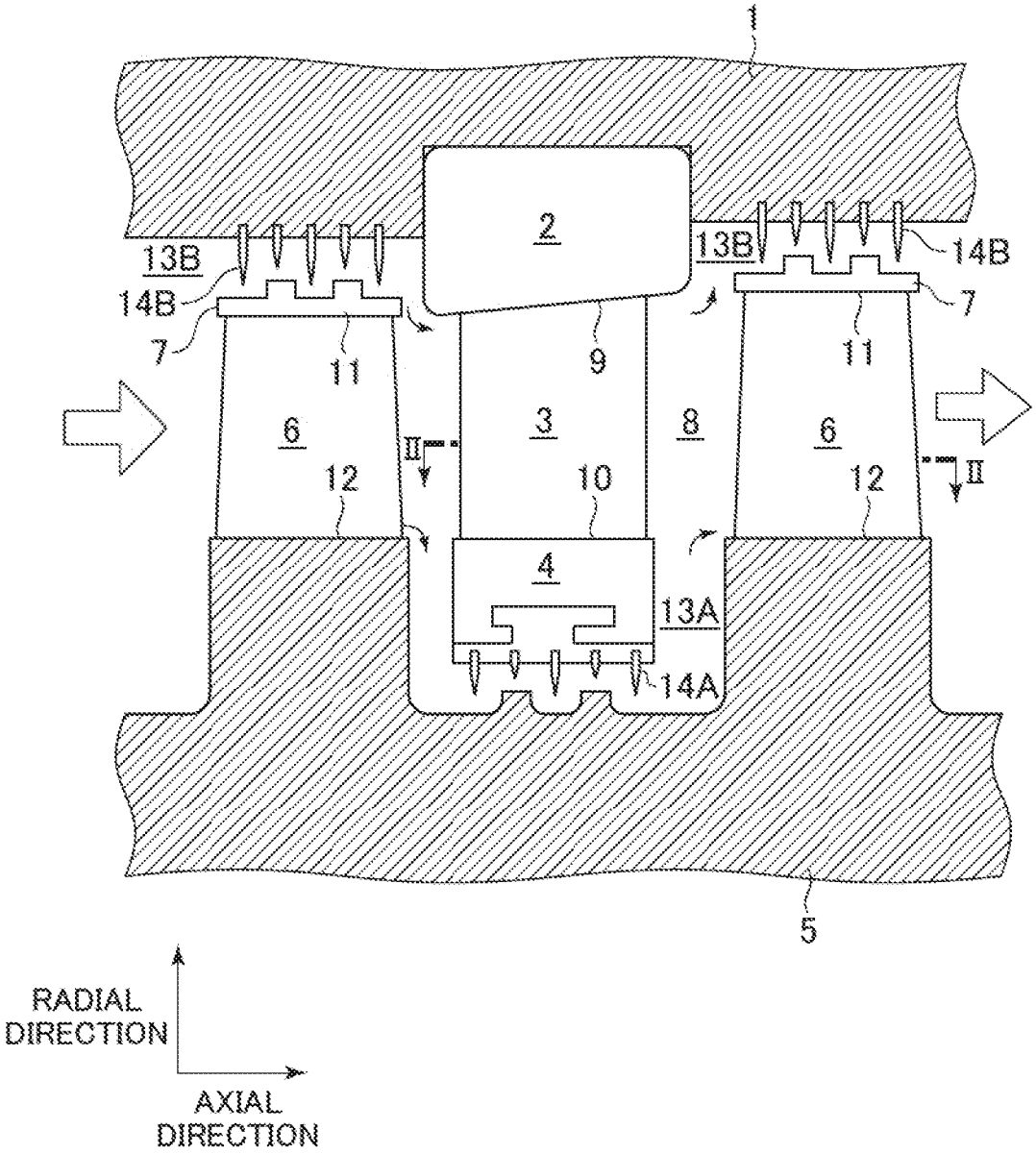
FIG. 1 is an axial cross-sectional view schematically representing a partial structure of a steam turbine in a first embodiment of the present invention.
Figure 2:
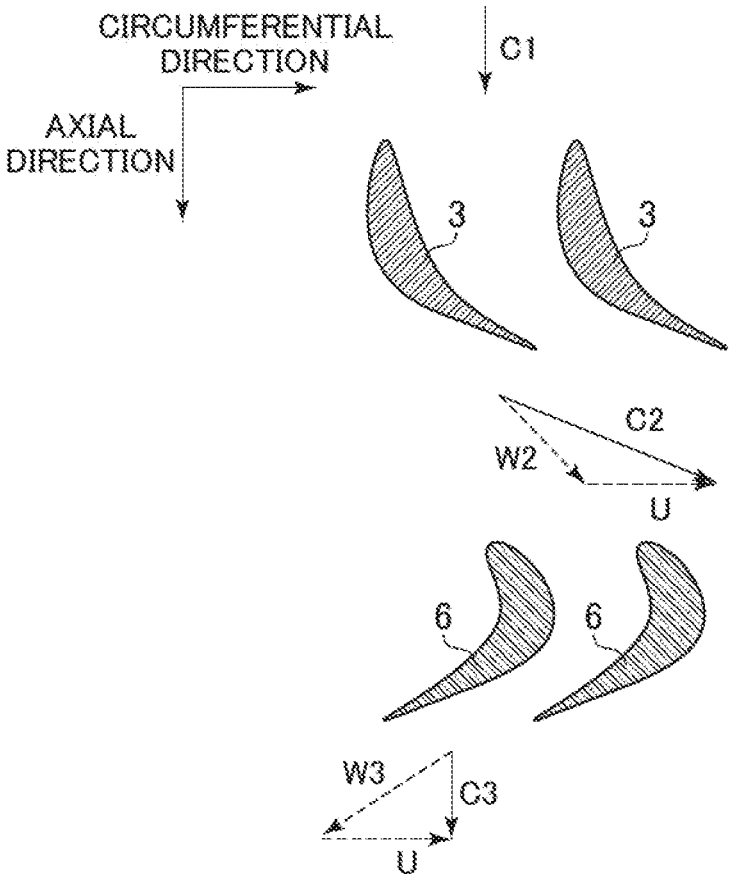
FIG. 2 is a circumferential cross-sectional view which is taken along a cross-section II-II in FIG. 1, and illustrates a flow in a main flow path.

FIG. 1 is an axial cross-sectional view schematically representing a partial structure of a steam turbine in a first embodiment of the present invention. FIG. 2 is a circumferential cross-sectional view which is taken along the cross-section II-II in FIG. 1, and illustrates a flow in a main flow path.

The steam turbine in the present embodiment includes: an annular diaphragm outer ring 2 provided on the inner-circumference side of a casing 1; a plurality of stator blades 3 provided on the inner-circumference side of the diaphragm outer ring 2; and an annular diaphragm inner ring 4 provided on the inner-circumference side of the stator blades 3. The plurality of stator blades 3 are arrayed between the diaphragm outer ring 2 and the diaphragm inner ring 4 at predetermined intervals in the circumferential direction.

In addition, the steam turbine includes: a rotor 5; a plurality of moving blades 6 provided on the outer-circumference side of the rotor 5; and an annular shroud 7 provided on the outer-circumference side of the moving blades 6. The plurality of moving blades 6 are arrayed between the rotor 5 and the shroud 7 at predetermined intervals in the circumferential direction.

A main flow path 8 of the steam turbine is constituted by a flow path formed between an inner circumferential surface 9 of the diaphragm outer ring 2 and an outer circumferential surface 10 of the diaphragm inner ring 4, and a flow path formed between an inner circumferential surface 11 of the shroud 7 and an outer circumferential surface 12 of the rotor 5. That is, the diaphragm outer ring 2 has the inner circumferential surface 9 that interconnects the plurality of stator blades 3 on their outer-circumference side, and constitutes a wall surface of the main flow path 8. The diaphragm inner ring 4 has the outer circumferential surface 10 that interconnects the plurality of stator blades 3 on their inner-circumference side, and constitutes a wall surface of the main flow path 8. The shroud 7 has the inner circumferential surface 11 that interconnects the plurality of moving blades 6 on their outer-circumference side, and constitutes a wall surface of the main flow path 8. The rotor 5 has the outer circumferential surface 12 that interconnects the plurality of moving blades 6 on their inner-circumference side, and constitutes a wall surface of the main flow path 8.

In the main flow path 8, the plurality of stator blades 3, i.e., one stator blade row, are arranged, and the plurality of moving blades 6, i.e., one moving-blade row, are arranged on the downstream side of the plurality of stator blades 3, or the right side in FIG. 1. A combination of these stator blades 3 and moving blades 6 constitutes one stage. Note that although only moving blades 6 of the first stage, and stator blades 3 and moving blades 6 of the second stage are illustrated in FIG. 1 for convenience, the number of stages provided in the axial direction is typically three or larger in order to collect the internal energy of steam, or working fluid, efficiently.

Steam in the main flow path 8 flows as illustrated by thick arrows in FIG. 1. Then, the internal energy, i.e., pressure energy and the like, of the steam is converted into kinetic energy, i.e., velocity energy, at the stator blades 3, and the kinetic energy of the steam is converted into the rotational energy of the rotor 5 at the moving blades 6. In addition, it is configured such that a power generator, not illustrated, is connected to an end portion of the rotor 5, and the power generator converts the rotational energy of the rotor 5 into electrical energy.

A steam flow, or a main flow, in the main flow path 8 is explained with reference to FIG. 2. Steam flows in from the upstream edge side of the stator blades 3, or from the top side in FIG. 2, with an absolute velocity vector Cl, specifically, an absolute flow with almost no circumferential velocity components. Then, when passing through between the stator blades 3, the steam is accelerated, and caused to turn to have an absolute velocity vector C2, specifically, an absolute flow with a large circumferential velocity component, and flows out from the downstream edge side of the stator blade 3, or from the bottom side in FIG. 2. Most parts of the steam having flowed out of the stator blades 3 collide with the moving blades 6 to rotate the rotor 5 at a velocity U. At this time, when passing through the moving blades 6, the steam is decelerated, and caused to turn, and a relative velocity vector W2 turns a relative velocity vector W3. Accordingly, the steam flowing out of the moving blades 6 has an absolute velocity vector C3, specifically, an absolute flow with almost no circumferential velocity components.

With reference again to FIG. 1 mentioned above, a cavity 13A is formed between the diaphragm inner ring 4 and the rotor 5. Part of the steam flows into the cavity 13A from the upstream side of the stator blades 3 in the main flow path 8, and flows out of the cavity 13A to the downstream side of the stator blades 3 in the main flow path 8. Since the part of the steam is neither accelerated nor caused to turn by the stator blades 3, loss occurs. In order to reduce the loss, the cavity 13A is provided with a labyrinth seal 14A. The labyrinth seal 14A is constituted, for example, by a plurality of fins provided on the side of the diaphragm inner ring 4, and a plurality of protrusions formed on the side of the rotor 5.

A cavity 13B is formed between the shroud 7 and the casing 1. Part of the steam flows into the cavity 13B from the upstream side of the moving blades 6 in the main flow path 8, and flows out of the cavity 13B to the downstream side of the moving blades 6 in the main flow path 8. Since the part of the steam does not apply rotational force to the moving blades 6, loss occurs. In order to reduce the loss, the cavity 13B is provided with a labyrinth seal 14B. The labyrinth seal 14B is constituted, for example, by a plurality of fins provided on the side of the casing 1, and a plurality of protrusions formed on the side of the shroud 7.

Meanwhile, there is typically a circumferential pressure distribution produced on the outlet side of the stator blades 3 in the main flow path 8. Explaining specifically, the static pressure becomes relatively lower in an area that is on the downstream side of a throat 17 where the distance between a suction surface, or a rear surface, 15 of a stator blade 3A of a pair of adjacent blades and a pressure surface, or a front surface, 16 of a stator blade 3B of the pair of adjacent blades becomes the shortest, and that lies in the circumferential direction within a range of a throat position P1 on the suction surface 15 of the stator blade 3A to a downstream edge position P2 of the stator blade 3A, see FIG. 3 mentioned below. Accordingly, a flow to spout out of the cavity 13A toward the main flow path 8 is generated in the area. On the other hand, the static pressure becomes relatively higher in an area that is on the downstream side of the throat 17, and that lies in the circumferential direction within a range of the throat position P1 on the suction surface 15 of the stator blade 3A to a downstream edge position P3 of the stator blade 3B, see FIG. 3 mentioned below. Accordingly, a flow to leak out of the main flow path 8 toward the cavity 13A is generated in the area. Then, due to the difference between the flows in the circumferential direction, interference loss increases. In addition, due to the influence of the difference between the flows mentioned before, secondary flow loss at moving blades 6 on the downstream side increases.

Figure 3:
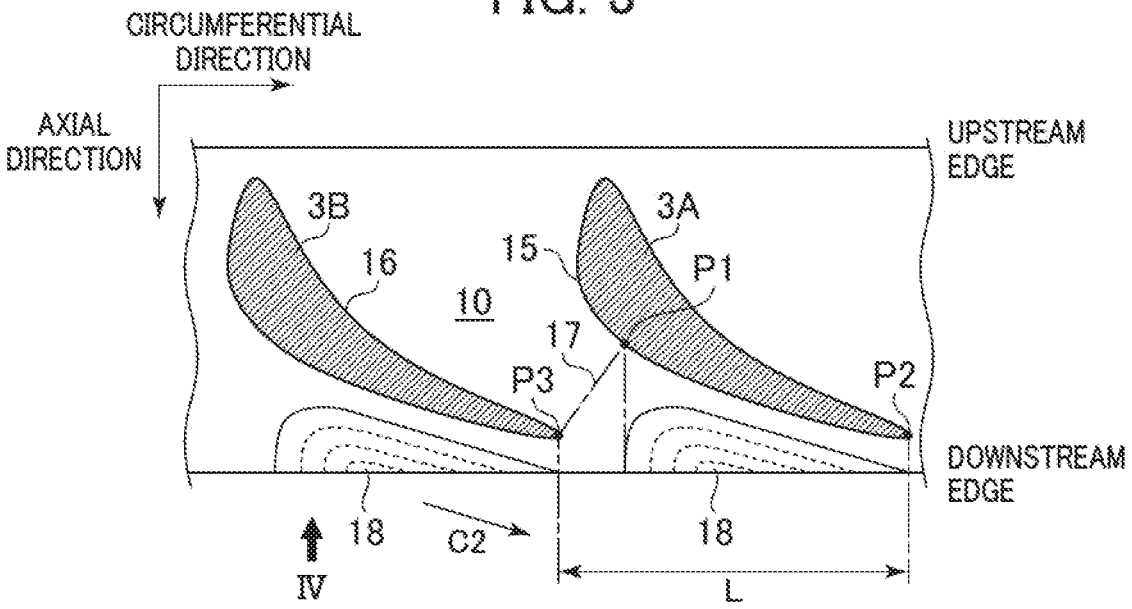
FIG. 3 is a net drawing representing a structure of an outer circumferential surface of a diaphragm inner ring in the first embodiment of the present invention.
Figure 4:
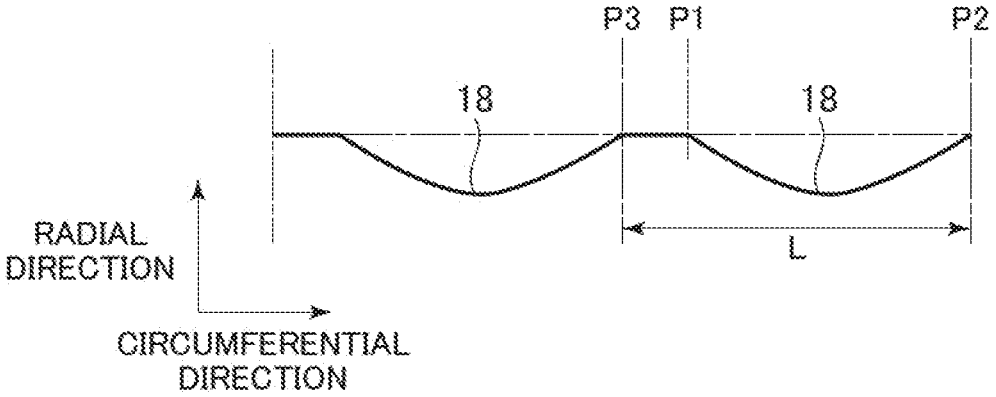
FIG. 4 is a figure as seen from a direction of an arrow IV in FIG. 3.

In view of this, in the present embodiment, the outer circumferential surface 10 of the diaphragm inner ring 4 has a structure for reducing the pressure difference in the circumferential direction. The details of the structure are explained with reference to FIG. 3 and FIG. 4. FIG. 3 is a net drawing representing the structure of the outer circumferential surface of the diaphragm inner ring in the present embodiment. FIG. 4 is a figure as seen from the direction of the arrow IV in FIG. 3. Note that dotted lines in FIG. 3 indicate contour lines of depressed portions.

The outer circumferential surface 10 of the diaphragm inner ring 4 in the present embodiment is an approximately cylindrical surface, and has a plurality of depressed portions 18 that are depressed radially inward from this cylindrical surface.

Each depressed portion 18 is formed in an area that is on the downstream side of the throat 17 where the distance between the suction surface 15 of the stator blade 3A of the pair of adjacent blades and the pressure surface 16 of the stator blade 3B of the pair of adjacent blades becomes the shortest, and that lies in the circumferential direction within a range of the throat position P1 on the suction surface 15 of the stator blade 3A to the downstream edge position P2 of the stator blade 3A. Further, the area includes the downstream edge position of the outer circumferential surface 10 in the axial direction, and lies in a range including not only the downstream side but also upstream side of the downstream edge position P2 of the stator blade 3A.

In addition, each depressed portion 18 is formed along the direction of a steam flow on the downstream side of the throat 17, i.e., the direction of the absolute velocity vector C2 mentioned above. Explaining specifically, each cross-section of a depressed portion 18 in the circumferential direction has an approximately triangular shape, for example, and a straight line linking the bottoms of individual cross-sections coincides with the direction of the steam flow. In addition, each depressed portion 18 is formed to be deeper gradually along the direction of the steam flow. Thereby, it is configured such that the influence on the direction of the steam flow is reduced.

In the present embodiment, due to the depressed portion 18 on the outer circumferential surface 10 of the diaphragm inner ring 4, the width of the main flow path 8 increases in the area of the depressed portion 18 in the circumferential direction. Thereby, the flow rate of the steam in the area in the circumferential direction lowers, and the static pressure rises. Accordingly, it is possible to reduce pressure differences in the circumferential direction to reduce differences between flows in the circumferential direction. As a result, interference loss, and secondary flow loss at moving blades 6 on the downstream side can be reduced.

Figure 5:
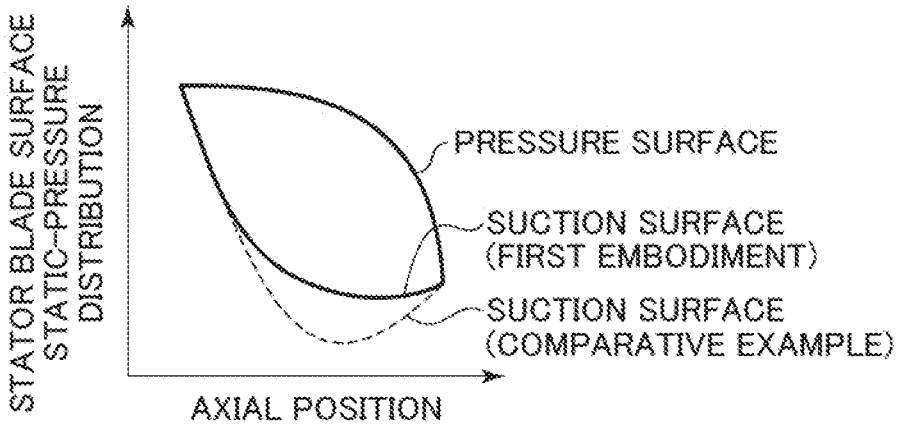
FIG. 5 is a figure representing a stator blade surface static-pressure distributions in the first embodiment of the present invention and a comparative example.

In addition, in the present embodiment, the depressed portion 18 is formed in an area including, in the axial direction, not only the downstream side but also upstream side of the downstream edge position P2 of the stator blade 3A. That is, it is formed to reach a position close to the suction surface 15 of the stator blade 3A. Thereby, as illustrated in FIG. 5, the static pressure at the suction surface 15 of the stator blade 3A rises as compared with a comparative example in which the depressed portion 18 is not formed. Accordingly, it is possible to reduce the pressure difference between the pressure surface and suction surface of a stator blade to reduce secondary flow loss at stator blades.

Note that although, in the example explained in the first embodiment, the depressed portion 18 is formed in the area that lies in the circumferential direction within the range of the throat position P1 on the suction surface 15 of the stator blade 3A to the downstream edge position P2 of the stator blade 3A, this is not the sole example, and the depressed portion 18 only has to be formed in the area mentioned before. Explaining specifically, the depressed portion 18 may be formed in an area that starts from a position shifted toward the downstream edge position P2 from the throat position P1 by approximately 10% of the pitch length L between the blades, for example. In addition, the depressed portion 18 may be formed in an area that reaches a position shifted from the downstream edge position P2 toward the throat position P1 by approximately 10% of the pitch length L between the blades, for example. In such a case also, effects similar to those explained above can be attained.

Alternatively, the depressed portion 18 may be formed to slightly go beyond the area that lies in the circumferential direction within a range of the throat position P1 on the suction surface 15 of the stator blade 3A to the downstream edge position P2 of the stator blade 3A. Explaining specifically, the depressed portion 18 may be formed in an area that starts from a position shifted toward a side opposite to the downstream edge position P2 from the throat position P1 by approximately 10% of the pitch length L between the blades, for example. In addition, the depressed portion 18 may be formed in an area that reaches a position shifted from the downstream edge position P2 toward a side opposite to the throat position P1 by approximately 10% of the pitch length L between the blades, for example. In such a case also, effects similar to those explained above can be attained.

In addition, although, in the example explained in the first embodiment, the depressed portion 18 is formed in an area including, in the axial direction, not only the downstream side but also upstream side of the downstream edge position P2 of the stator blade 3A, this is not the sole example. That is, although it becomes not possible to attain the effect of attempting to reduce secondary flow loss at stator blades, the depressed portion 18 may be formed in an area that includes, in the axial direction, only the downstream side of the downstream edge position P2 of the stator blade 3A.

A second embodiment of the present invention is explained with reference to FIG. 6 and FIG. 7. Note that portions in the present embodiment that are equivalent to those in the first embodiment are given the same signs, and explanations thereof are omitted as appropriate.

Figure 6:
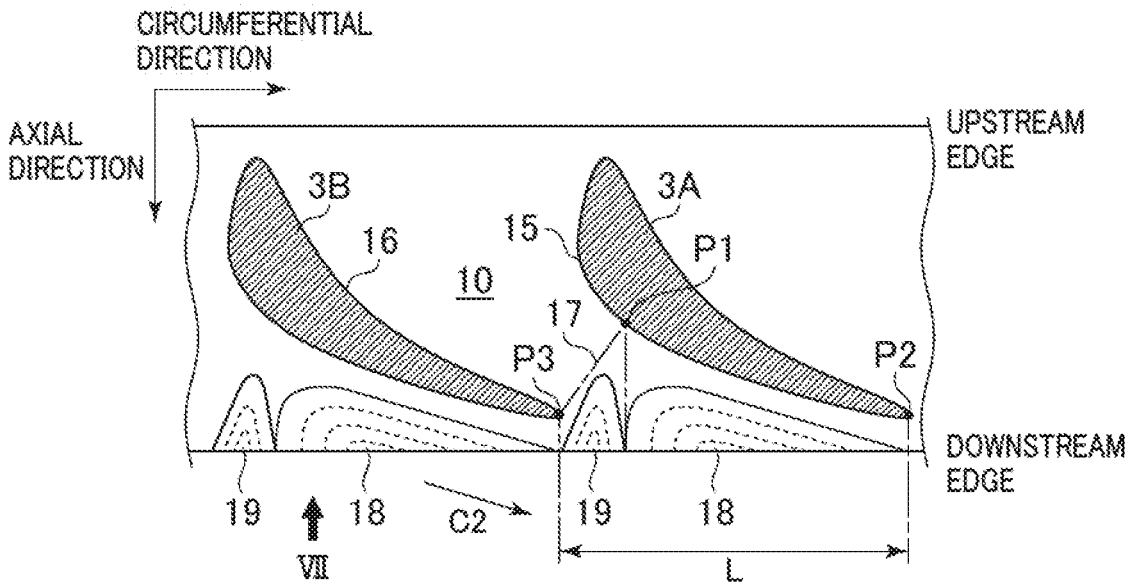
FIG. 6 is a net drawing representing a structure of an outer circumferential surface of a diaphragm inner ring in a second embodiment of the present invention.
Figure 7:
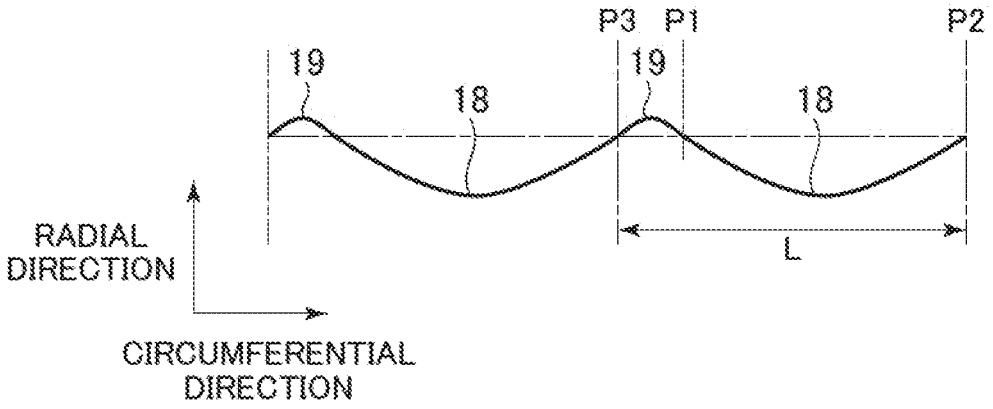
FIG. 7 is a figure as seen from a direction of an arrow VII in FIG. 6.

FIG. 6 is a net drawing representing the structure of the outer circumferential surface of the diaphragm inner ring in the present embodiment. FIG. 7 is a figure as seen from the direction of the arrow VII in FIG. 6. Note that dotted lines in FIG. 6 indicate contour lines of depressed portions and protruding portions.

Similar to the first embodiment, the outer circumferential surface 10 of the diaphragm inner ring 4 in the present embodiment has an approximately cylindrical surface, and has a plurality of depressed portions 18 that are depressed radially inward from this cylindrical surface. The outer circumferential surface 10 of the diaphragm inner ring 4 in the present embodiment further has a plurality of protruding portions 19 that protrude radially outward from the cylindrical surface.

Each protruding portion 19 is formed in an area that is on the downstream side of the throat 17 where the distance between the suction surface 15 of the stator blade 3A of the pair of adjacent blades and the pressure surface 16 of the stator blade 3B of the pair of adjacent blades becomes the shortest, and that lies in the circumferential direction within a range of the throat position P1 on the suction surface 15 of the stator blade 3A to the downstream edge position P3 of the stator blade 3B. Further, the area includes, in the axial direction, the downstream edge position of the outer circumferential surface 10, and lies in an area including not only the downstream side but also upstream side of the downstream edge position P3 of the stator blade 3B.

In addition, each protruding portion 19 is formed along the axial direction. Explaining specifically, each cross-section of a protruding portion 19 in the circumferential direction has an approximately triangular shape, for example, and a straight line linking the vertexes of individual cross-sections coincides with the axial direction. In addition, each protruding portion 19 is formed to be higher gradually toward the downstream side of the axial direction.

In the present embodiment, due to the protruding portion 19 on the outer circumferential surface 10 of the diaphragm inner ring 4, the width of the main flow path 8 decreases in the area of the protruding portion 19 in the circumferential direction. Thereby, the flow rate of the steam in the area in the circumferential direction rises, and the static pressure lowers. Accordingly, as compared with the first embodiment, it is possible to further reduce pressure differences in the circumferential direction to further reduce differences between flows in the circumferential direction. As a result, interference loss, and secondary flow loss at moving blades 6 on the downstream side can be reduced further.

Note that although, in the example explained in the second embodiment, the protruding portion 19 is formed in the area that lies in the circumferential direction within the range of the throat position P1 on the suction surface 15 of the stator blade 3B to the downstream edge position P3 of the stator blade 3A, this is not the sole example, and the protruding portion 19 only has to be formed in the area mentioned before. Explaining specifically, the protruding portion 19 may be formed in an area that starts from a position shifted toward the downstream edge position P3 from the throat position P1 by approximately 10% of the pitch length L between the blades, for example. In addition, the protruding portion 19 may be formed in an area that reaches a position shifted from the downstream edge position P3 toward the throat position P1 by approximately 10% of the pitch length L between the blades, for example. In such a case also, effects similar to those explained above can be attained.

Alternatively, the protruding portion 19 may be formed to slightly go beyond the area that lies in the circumferential direction within the range of the throat position P1 on the suction surface 15 of the stator blade 3A to the downstream edge position P3 of the stator blade 3B. Note that the depressed portion 18 needs to be reduced in size correspondingly. Explaining specifically, the protruding portion 19 may be formed in an area that starts from a position shifted toward a side opposite to the downstream edge position P3 from the throat position P1 by approximately 10% of the pitch length L between the blades, for example. In addition, the protruding portion 19 may be formed in an area that reaches a position shifted from the downstream edge position P3 toward a side opposite to the throat position P1 by approximately 10% of the pitch length L between the blades, for example. In such a case also, effects similar to those explained above can be attained.

In addition, although, in the example explained in the second embodiment, the protruding portion 19 is formed in the area including, in the axial direction, not only the downstream side but also upstream side of the downstream edge position P3 of the stator blade 3B, this is not the sole example. That is, the protruding portion 19 may be formed in an area including, in the axial direction, only the downstream side of the downstream edge position P3 of the stator blade 3B.

In addition, although in the examples explained in the first and second embodiments, features of the present invention are applied to the outer circumferential surface 10 of the diaphragm inner ring 4, these are not the sole examples. That is, the features may be applied to any one of the inner circumferential surface 9 of the diaphragm outer ring 2, the inner circumferential surface 11 of the shroud 7, and the outer circumferential surface 12 of the rotor 5.

In addition, although in the examples explained in the first and second embodiments, the present invention is applied to a steam turbine, these are not the sole examples. That is, the present invention may be applied to a gas turbine.

What is claimed is:

1. An axial flow turbine comprising:

a plurality of blades arrayed in a circumferential direction; and a member having a circumferential surface that interconnects the plurality of blades on their inner-circumference side or outer-circumference side and constitutes a wall surface of a main flow path, wherein the circumferential surface of the member has a plurality of depressed portions, each of the depressed portions is formed in an area that is on a downstream side of a throat where a distance between a suction surface of one blade of a pair of adjacent blades and a pressure surface of the other blade of the pair of adjacent blades becomes shortest, and that lies in the circumferential direction within a range of a throat position on the suction surface of the one blade to a downstream edge position of the one blade, the area including a downstream edge position of the circumferential surface in an axial direction, each of the plurality of depressed portions is formed: i) along a working fluid flow direction on the downstream side of the throat, and ii) to be deeper gradually along the working fluid flow direction, the circumferential surface of the member has a plurality of protruding portions, and each of the protruding portions is formed in an area that is on the downstream side of the throat, and that lies in the circumferential direction within a range of the throat position on the suction surface of the one blade to a downstream edge position of the other blade, the area including the downstream edge position of the circumferential surface of the member in the axial direction.

2. The axial flow turbine according to claim 1, wherein each of the plurality of depressed portions is formed in an area including, in the axial direction, a downstream side and an upstream side of the downstream edge position of the one blade of the pair of adjacent blades.

3. The axial flow turbine according to claim 1, wherein the member is any one of:

a diaphragm inner ring having an outer circumferential surface that interconnects a plurality of stator blades on their inner-circumference side and constitutes the wall surface of the main flow path;

a diaphragm outer ring having an inner circumferential surface that interconnects a plurality of stator blades on their outer-circumference side and constitutes the wall surface of the main flow path;

a rotor having an outer circumferential surface that interconnects a plurality of moving blades on their inner-circumference side and constitutes the wall surface of the main flow path; and a shroud having an inner circumferential surface that interconnects a plurality of moving blades on their outer-circumference side and constitutes the wall surface of the main flow path.

4. The axial flow turbine according to claim 1, wherein the deeper gradually along the working fluid flow direction is until the downstream edge position of the circumferential surface.

5. An axial flow turbine comprising:

a plurality of blades arrayed in a circumferential direction; and a member having a circumferential surface that interconnects the plurality of blades on their inner-circumference side or outer-circumference side and constitutes a wall surface of a main flow path, wherein the circumferential surface of the member has a plurality of depressed portions, each of the depressed portions is formed in an area that is on a downstream side of a throat where a distance between a suction surface of one blade of a pair of adjacent blades and a pressure surface of the other blade of the pair of adjacent blades becomes shortest, and that lies in the circumferential direction within a range of a throat position on the suction surface of the one blade to a downstream edge position of the one blade, the area including a downstream edge position of the circumferential surface in an axial direction, each of the plurality of depressed portions is formed: i) along a working fluid flow direction on the downstream side of the throat, and ii) to be deeper gradually along the working fluid flow direction, and the deeper gradually along the working fluid flow direction is until the downstream edge position of the circumferential surface.

* * * * *